US007933547B2

(12) United States Patent
Brown et al.

(10) Patent No.: US 7,933,547 B2
(45) Date of Patent: Apr. 26, 2011

(54) APPARATUS AND METHOD FOR INTERFERING WITH WIRELESS COMMUNICATIONS DEVICES POSITIONED IN A VOLUME OCCUPIED BY A HUMAN DRIVER

(75) Inventors: Craig S. Brown, Bainbridge Island, WA (US); Joveliano C. Trinidad, Bainbridge Island, WA (US)

(73) Assignee: D3T, LLC, Seattle, WA (US)

( * ) Notice: Subject to any disclaimer, the term of this patent is extended or adjusted under 35 U.S.C. 154(b) by 547 days.

(21) Appl. No.: 12/110,060

(22) Filed: Apr. 25, 2008

(65) Prior Publication Data

US 2008/0268768 A1 Oct. 30, 2008

Related U.S. Application Data

(60) Provisional application No. 60/914,670, filed on Apr. 27, 2007.

(51) Int. Cl.
*H04K 3/00* (2006.01)

(52) U.S. Cl. ..... 455/1; 455/420; 455/63.4; 455/41.2; 455/569.2

(58) Field of Classification Search ..... 455/1, 41.2, 455/63.1, 63.3, 63.4, 25, 99, 140, 420, 414.1, 455/552.1, 562.1, 565, 569.2, 575.9, 297, 455/417, 418, 419, 456.4, 466, 345; 701/200, 701/201; 340/572.1, 573.1
See application file for complete search history.

(56) References Cited

U.S. PATENT DOCUMENTS

| | | | | |
|---|---|---|---|---|
| 6,771,946 | B1 * | 8/2004 | Oyaski | 455/345 |
| 7,123,874 | B1 * | 10/2006 | Brennan | 455/1 |
| 2007/0032225 | A1 * | 2/2007 | Konicek et al. | 455/417 |
| 2008/0268767 | A1 | 10/2008 | Brown et al. | 455/1 |
| 2008/0268769 | A1 | 10/2008 | Brown et al. | 455/1 |
| 2010/0029270 | A1 * | 2/2010 | Kiddie et al. | 455/428 |
| 2010/0234047 | A1 * | 9/2010 | Lipovski | 455/456.4 |

OTHER PUBLICATIONS

U.S. Appl. No. 12/109,266, filed Apr. 24, 2008, Brown et al.
U.S. Appl. No. 12/110,077, filed Apr. 25, 2008, Brown et al.

* cited by examiner

*Primary Examiner* — Tan Trinh
(74) *Attorney, Agent, or Firm* — Seed IP Law Group PLLC

(57) ABSTRACT

An apparatus operable to disable operation of driver side wireless communications devices, for use within a vehicle, includes a drive circuit coupled to at least one active antenna element to produce interference within at least one wireless communications band of frequencies in response to movement of a vehicle above a defined threshold. The active antenna element being mounted proximate a driver side seat-back and/or visor. The interference may take the form of a bare carrier wave, or may take the form of noise, and is transmitted at sufficient power to interfere with communication between the driver side wireless communications device and a destination device.

43 Claims, 13 Drawing Sheets

APPARATUS AND METHOD FOR INTERFERING WITH WIRELESS COMMUNICATIONS DEVICES POSITIONED IN A VOLUME OCCUPIED BY A HUMAN DRIVER

BACKGROUND OF THE INVENTION

1. Field of the Invention

This disclosure generally relates to the field of wireless communications, and more particularly to wireless communications devices used within vehicles.

2. Description of the Related Art

Wireless communications devices, for example cellular phones, satellite phones, pagers, text messaging devices, personal digital assistants (e.g., BLACKBERRY® and TREO®) and the like are becoming ubiquitous.

Such devices, and in particular cellular phones are currently being used by an increasing number of people while driving. Research studies have shown that cellular phone usage diverts the concentration or attention of the motorist from the road and significantly increases the likelihood of an accident. Some countries as well as several states in the United States have banned the usage of hand-held cell phone devices during driving. However, studies indicate that usage of hands-free cellular phones are almost as distracting as hand-held cellular phones. At least one study suggests that hands-free cellular phone usage is almost the equivalent of driving while intoxicated.

Compliance with laws banning cellular phone usage appears to be low, and enforcement requires the diversion of police resources, which may otherwise be used to address other issues. Consequently, a new approach to addressing cellular phone usage in vehicles is therefore desirable.

BRIEF SUMMARY OF THE INVENTION

According to one aspect, an apparatus operable to disable operation of wireless communications devices for use within a vehicle having a driver's seat from which a human driver controls the vehicle is disclosed that includes a directional antenna including at least one active antenna element, the directional antenna mounted in one of a seat back or a head rest of the driver's seat or in a visor that is positioned above and directly in front of the driver's seat, the directional antenna having a principal axis of emission directed toward a portion of the driver's seat to be occupied by the human driver while controlling the vehicle, and a drive circuit coupled to drive the at least one active antenna element to produce interference within at least one wireless communications band of frequencies in response to movement of the vehicle above a defined threshold, and at sufficiently high power to effectively interfere with communication between a destination device and a wireless communications device positioned in a volume to be occupied by the human driver when the human driver controls the vehicle where the interference disables the communication, and at sufficiently low power to not effectively interfere with communications between the destination device and a wireless communications device positioned relatively behind the driver's seat. The interference may take the form of a bare carrier wave (i.e., a carrier wave with no signal or noise imposed thereon), or may take the form of noise or a carrier wave imposed with noise.

According to another aspect, a method to disable operation of wireless communications devices within vehicles having a driver's seat to be occupied by a human driver when controlling the vehicle is disclosed that includes locating a directional antenna having at least one active antenna element in one of a seatback or headrest of a driver's seat to be occupied by a human driver when controlling a vehicle, or in a visor positioned relatively above and in front of a portion of the driver's seat to be occupied by the human driver when controlling the vehicle, determining whether the vehicle is moving above a defined threshold, and in response to determining that the vehicle is moving above the defined threshold, driving the at least one active antenna element at a power level that is sufficiently high to produce communications disabling interference within at least one wireless communications band of frequencies in a volume that would be occupied by the human driver when controlling the vehicle and that is sufficiently low to not produce communications disabling interference in a volume to be occupied by passengers who are not the driver.

According to yet another aspect, an apparatus operable to disable operation of wireless communications devices, for use within a vehicle having a driver's seat to be occupied by a human driver while controlling the vehicle is disclosed that includes a directional antenna including at least one active antenna element located in one of a seatback or a headrest of a driver's seat or a visor positioned relatively above and in front of the driver's seat and having a principal axis of emission directed toward a portion of the driver's seat to be occupied by the human driver when controlling the vehicle, and means for driving the at least one active antenna element to produce interference within at least one wireless communications band of frequencies in response to movement of the vehicle above a defined threshold, and at sufficient power to disably interfere with communication between a destination device and a wireless communications device positioned in a volume extending approximately perpendicularly upward from a portion of the driver's seat upon which the human driver sits when the human driver controls the vehicle while not disablingly interfering with wireless communications devices positioned in a volume to be occupied by human passengers that are not the human driver.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

Figure 10:
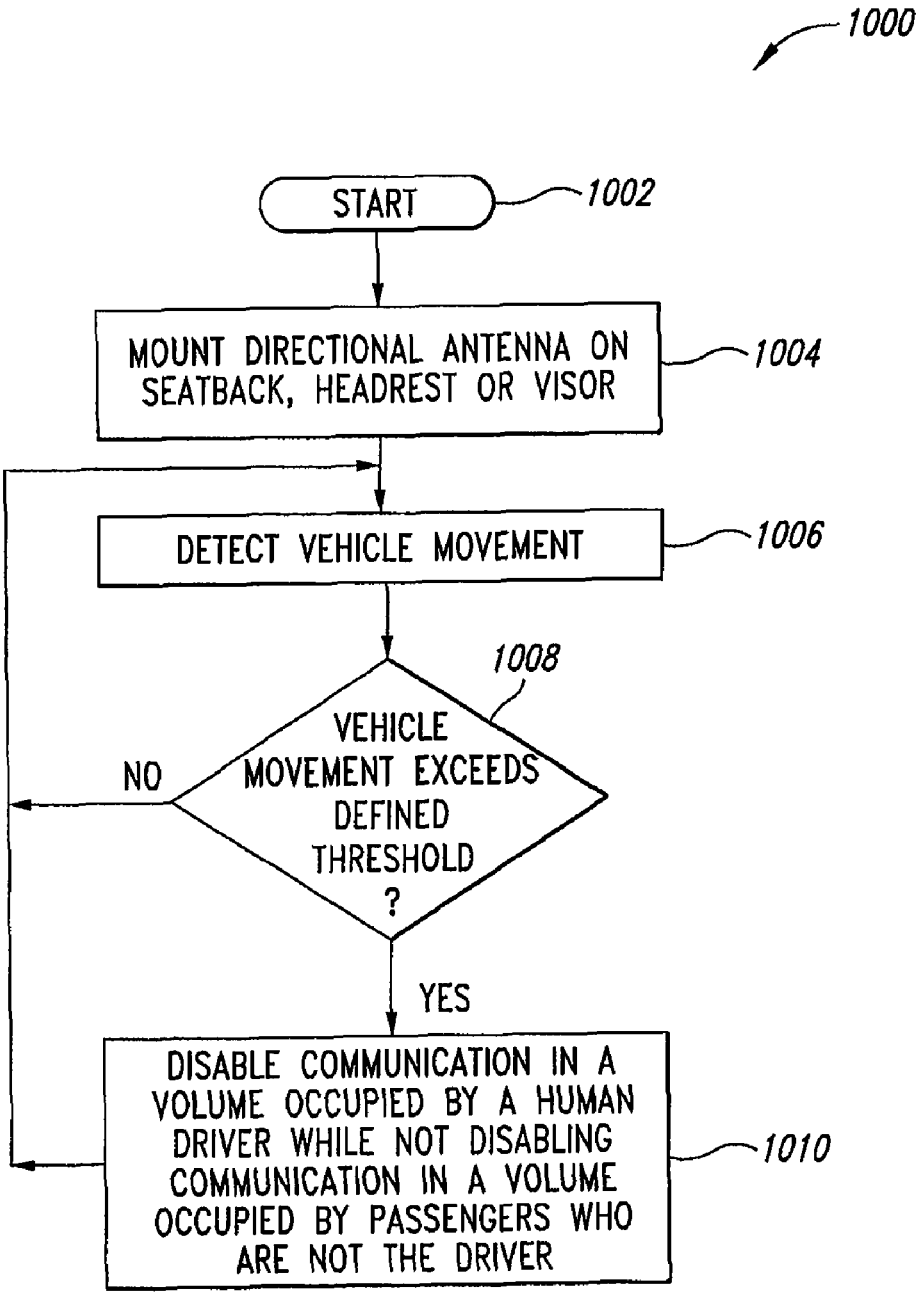

FIG. 10 is a flowchart of a method of disabling operation of the wireless communications device positioned within a volume of the vehicle to be occupied by a driver without disabling operation of a further wireless communications device positioned relatively behind a driver's seat and/or in a passenger seat spaced laterally with respect to the driver's seat, according to one illustrated embodiment.

DETAILED DESCRIPTION OF THE INVENTION

In the following description, certain specific details are set forth in order to provide a thorough understanding of various embodiments of the invention. However, one skilled in the art will understand that the embodiments may be practiced without these details. In other instances, well-known structures, equipment and processes associated with interfering with or jamming wireless communications, including voltage controlled oscillators, tuned circuits (e.g., LC circuits, RLC circuits), noise generators, RF (Radio Frequency) power amplification, antenna transmission and resulting structures have not been shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combinable in any suitable manner in one or more embodiments.

The headings provided herein are for convenience only and do not interpret the scope or meaning of the claimed invention.

Figure 1A:
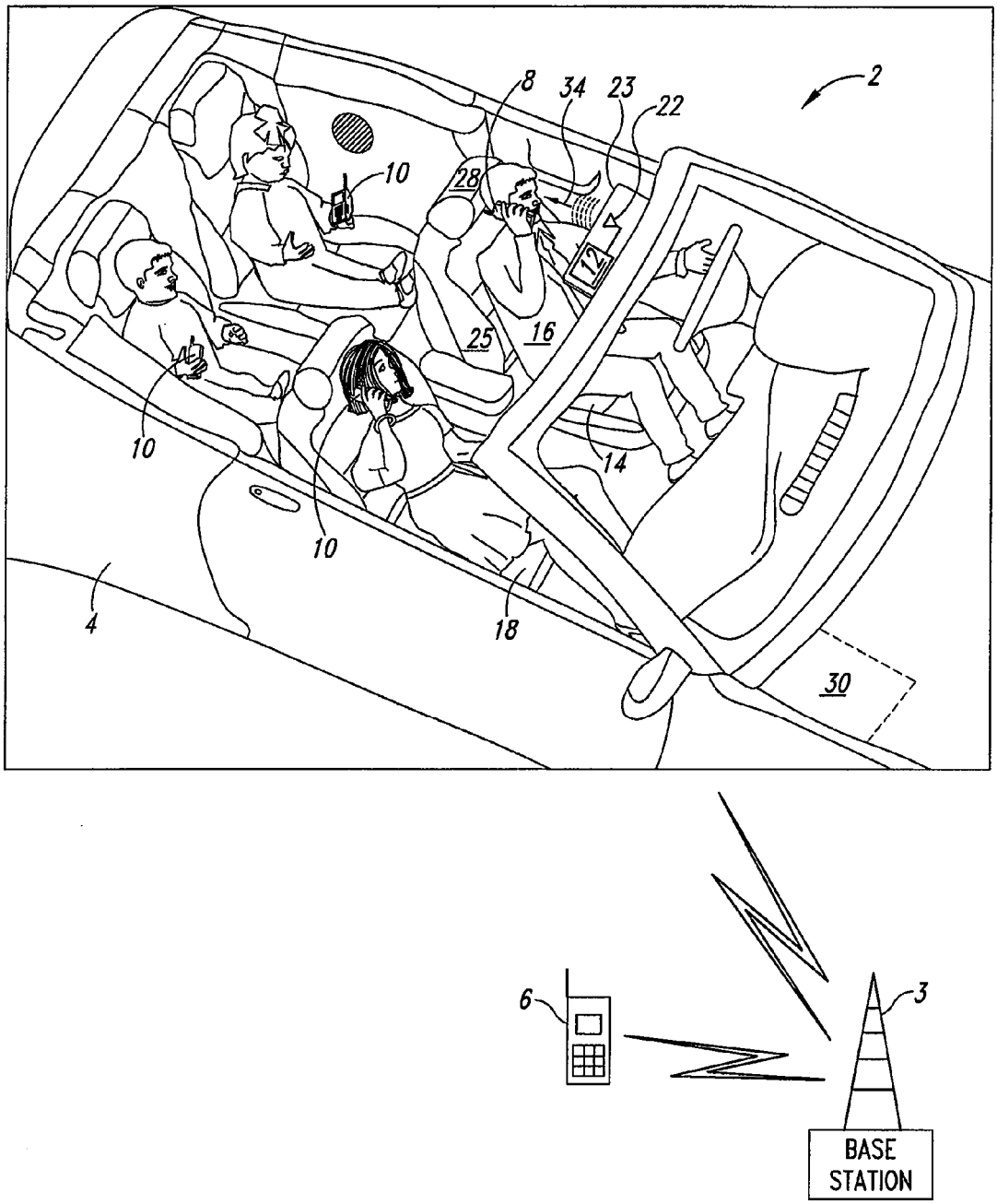
FIG. 1A is an isometric illustration of a communications system including an interference device having at least one active antenna element mounted on or embedded in a visor of a vehicle, according to one illustrated embodiment.
Figure 1B:
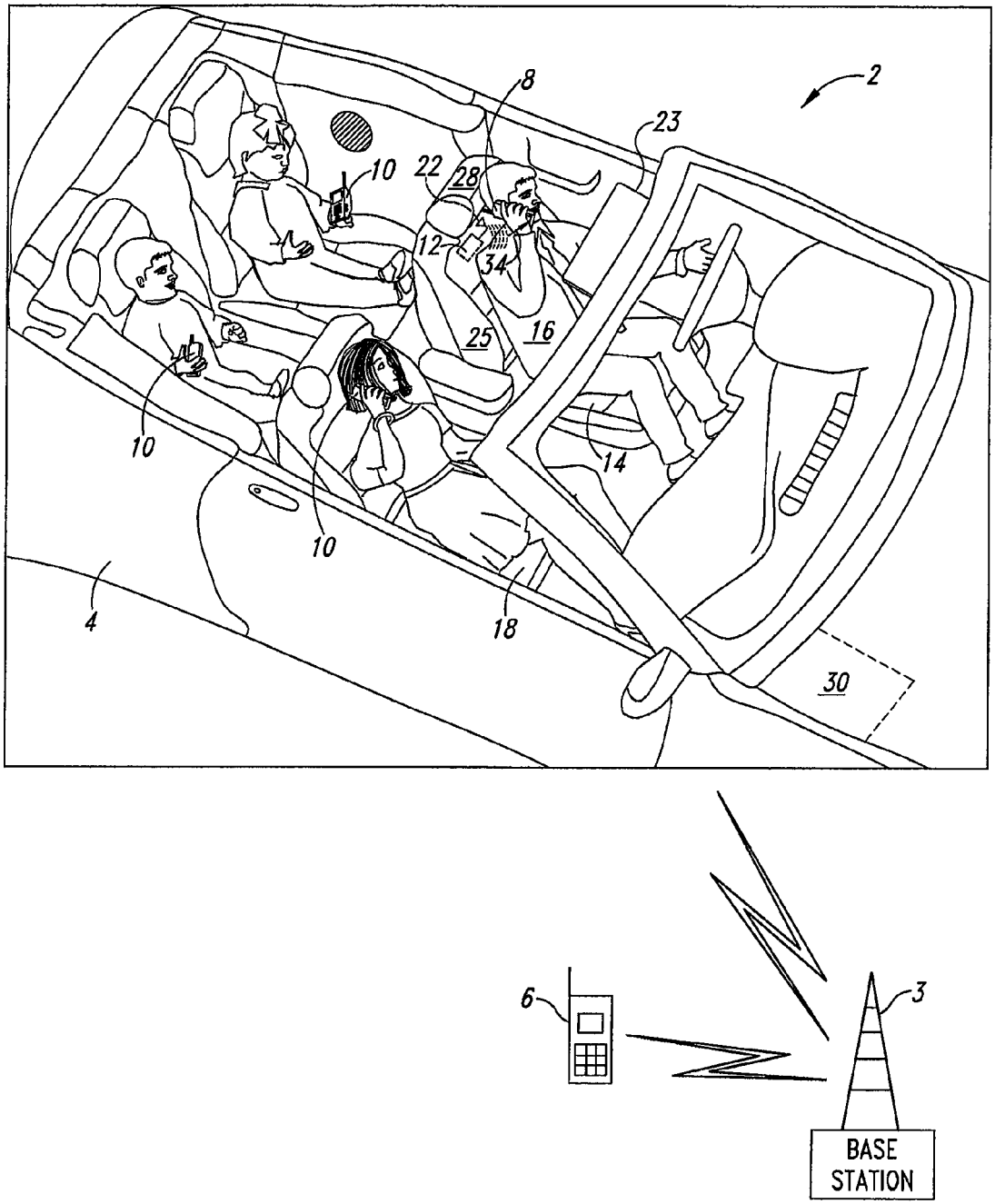
FIG. 1B is an isometric illustration of a communications system including an interference device having at least one active antenna element mounted on or embedded in a seatback of a vehicle, according to one illustrated embodiment.
Figure 1C:
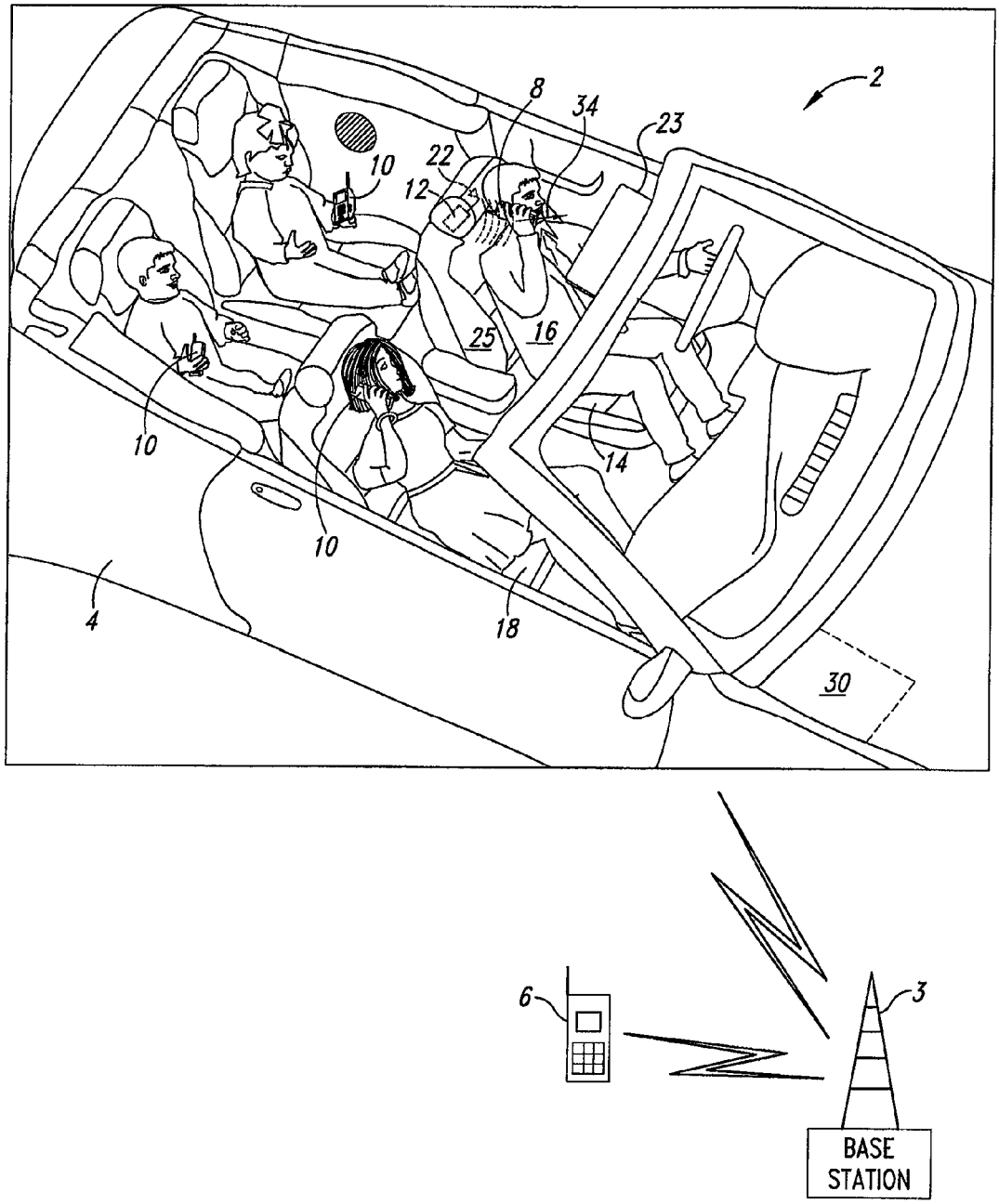
FIG. 1C is an isometric illustration of a communications system including an interference device having at least one active antenna element mounted on or embedded in a headrest of a vehicle, according to one illustrated embodiment.

FIGS. 1A-1C are schematic illustrations of a communications system 2 as used with a vehicle 4, according to an illustrated embodiment.

The communications system 2 comprises a wireless communications carrier system represented by base station 3, a destination device 6 (e.g., cellular phone or other mobile communications device, landline phone, emergency dispatch system, etc.) communicatively coupled to a driver operated wireless communications device 8 carried in the vehicle 4 via the base station 3. It is noted that while represented by a single base station 3, the wireless communications carrier system will typically include a plurality of base stations, as well as other systems (e.g., Home Location Register or "HLR", Visitor Location Register or "VLR", Authentication Center or "AuC").

An interference device 12 is installed in or otherwise carried by the vehicle 4 or occupant thereof. The interference device 12 is operable to substantially interfere with communication between the driver operated wireless communications device 8 and the base station 3 to a degree sufficient to effectively render the wireless communications device 8 operated by a human driver 16 of the vehicle 4 inoperable.

The vehicle 4 comprises a driver's seat 14 from which the human driver 16 controls the vehicle 4. In one embodiment, the driver operated wireless communications device 8 may be positioned in a volume to be occupied by the human driver 16 when the human driver 16 controls the vehicle 4. Such a volume may, for example, be defined by projecting a perimeter of a lower seat portion of the seat 14 on which the driver 16 sits perpendicularly upward, or upward at relatively small outward angle. A passenger operated wireless communications device 10 may be positioned relatively behind the driver's seat 14 and/or positioned in a passenger seat 18 spaced laterally with respect to the driver's seat 14. The passenger operated wireless communications device 10 may be, for example, positioned laterally with respect to the driver's seat 14 by a distance of approximately 1 foot or greater.

The interference device 12 comprises a drive circuit 20 (FIG. 3) electrically coupled to drive at least one active antenna element 22 to produce interference within at least one wireless communications band of frequencies in response to movement of the vehicle 4 above a defined threshold (e.g., 5 miles per hour, 2.5 miles per hour, etc.). The interference device 12 may transmit a bare carrier wave or noise or undesired signal imposed on a carrier wave within one frequency band or automatically switch between transmission within two or more frequency bands that are likely to be used by the wireless communications device 8, as discussed below. Additionally or alternatively, the interference device 12 may periodically detect the frequency band used by the driver operated wireless communications device 8 and adjust itself accordingly.

The active antenna element 22 may be a directional antenna carried by (e.g., mounted on or embedded in) one of a visor 23 (FIG. 1A), seatback 25 (FIG. 1B) or headrest 28 (FIG. 1C) of the vehicle 4. The visor 23, seatback 25 and headrest 28 are positioned for use by the human driver 16, when the human driver 16 controls the vehicle 4. In response to movement of the vehicle 4 above the defined threshold, the drive circuit 20 drives the active antenna element 22 to produce interference at sufficiently high power to effectively interfere with communication between the base station 3 and the driver operated wireless communications device 8, and drives the active antenna element 22 to produce interference at sufficiently low power to not effectively interfere with communications between base station 3 and the passenger operated wireless communications device 10.

The destination device 6 may, for example, be a further wireless communications device, landline phone, Internet phone, satellite phone, voicemail service, emergency provider or dispatch system, database, server, Web server or other system that may be accessed by wireless communications devices 8, 10.

The driver operated wireless communications device 8 and the passenger operated wireless communications device 10 may take a variety of forms, for example, cellular phones, satellite phones, pagers, text messaging devices, personal digital assistants (e.g., BLACKBERRY® and TREO®). The driver operated wireless communications device 8 may transmit and receive electromagnetic signals within multiple bands of frequencies such as, for example, an 800 MHZ band, 900 MHz band, an 1800 MHz band, or a 1900 MHz band.

The vehicle 4 may be any suitable structure for transport on land, sea or in air, such as, for example, an automobile, truck, boat, submarine, plane, or helicopter. The vehicle 4 may typically include a sensor 30 such as, for example, a speedometer, tachometer, acceleration sensor or a rotational encoder, to provide a signal indicative of movement of the vehicle 4. The signal may, for example, be indicative of change in position, rate of change in positions and/or rate of change in speed.

Figure 2A:
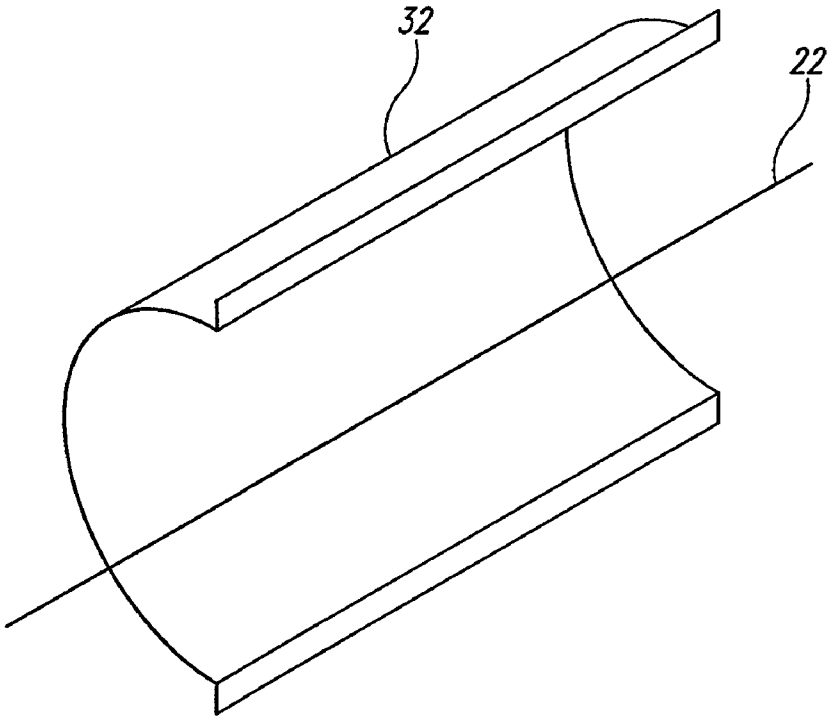
FIG. 2A is a detailed isometric bottom view of an active antenna element and a passive antenna element, according to one illustrated embodiment.

FIG. 2A shows a detailed isometric bottom view of the active antenna element 22 and a passive antenna element 32, according to one illustrated embodiment.

The active antenna element 22 may be mounted proximate the visor 23 (FIG. 1A), seatback 25 (FIG. 1B) or headrest 28 (FIG. 1C) of the vehicle 4 (e.g., automobile) with a primary axis 34 of radiation directed into the volume of the vehicle 4 to be occupied by the human driver 16 when the human driver 16 controls the vehicle 4. In another embodiment, the passive antenna element 32 may be positioned with respect to the active antenna element 22 to produce a directional radiation pattern with the primary axis 34 of the directional radiation pattern directed into the volume of the vehicle 4 to be occupied by the human driver 16 when the human driver 16 controls the vehicle 4. The active antenna element 22 and the passive antenna element 32 may be mounted proximate the visor 23, seatback 25 or headrest 28 of the vehicle 4. As illustrated in FIG. 2A, the passive antenna element 32 may be formed as a portion of a cylinder, with a longitudinally extending slot extending a length thereof. The passive antenna element 32 may be inexpensively manufactured by a stamping and rolling process.

Figure 2B:
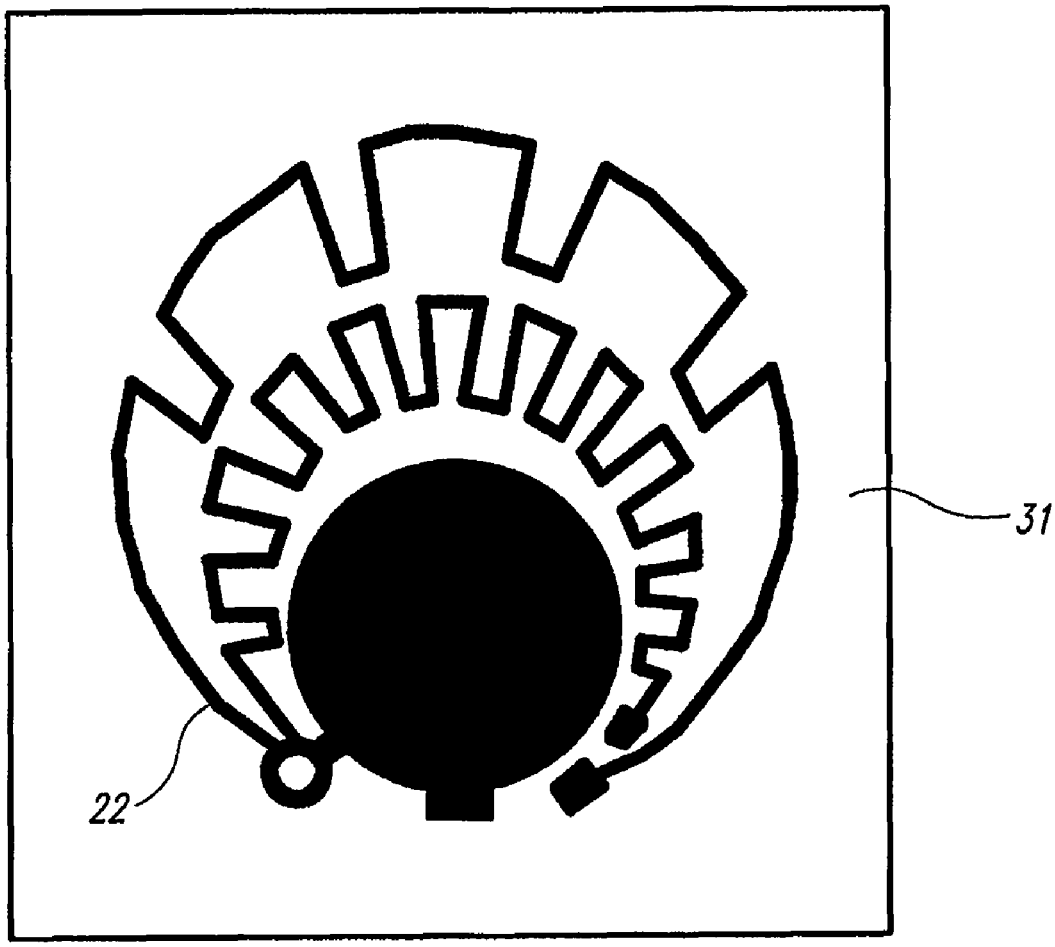
FIG. 2B is a schematic illustration of an active antenna element printed on a printed circuit board, according to one illustrated embodiment.

FIG. 2B shows a schematic illustration of the active antenna element 22 printed on a printed circuit board 31, according to one illustrated embodiment.

The active antenna element 22 may comprise conductive traces printed on a non-conductive substrate such as the printed circuit board 31. The active antenna element 22 may be designed as a dual-response Planar Inverted F-Antenna (PIFA) having a circular antenna design that is omni-directional with a reduced dB gain of approximately a few dB off the active antenna element 22 edges. The printed circuit board 31 with the active antenna element 22 printed thereon may be advantageously mounted perpendicular to the visor 23, seatback 25 or headrest 28 of the vehicle 4 so that the primary axis 34 of radiation may be directed into the volume of the vehicle 4 to be occupied by the human driver 16 when the human driver 16 controls the vehicle 4.

Figure 3:
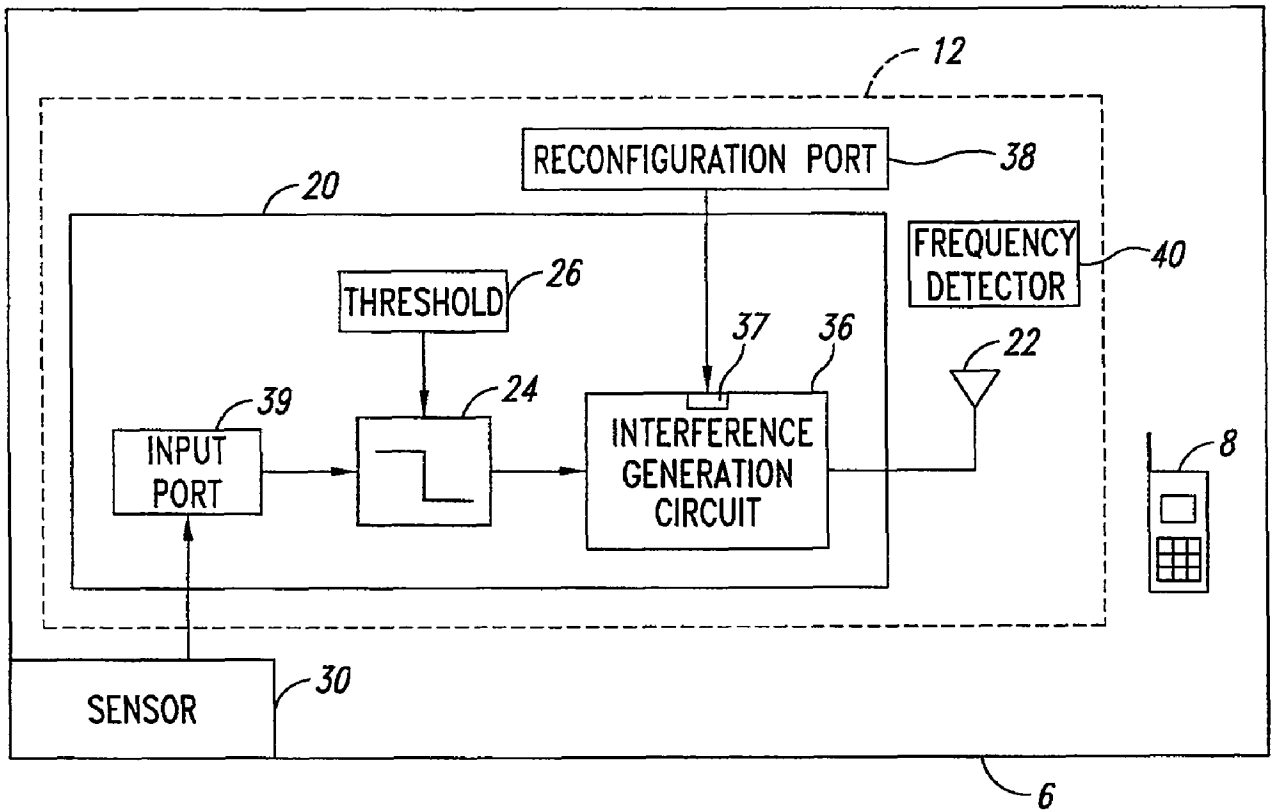
FIG. 3 is a schematic illustration of an interference device positioned within a vehicle, according to one illustrated embodiment.

FIG. 3 is a schematic illustration of the interference device 12 positioned within the vehicle 4, according to an illustrated embodiment.

The drive circuit 20 comprises at least one interference generation circuit 36 configured to cause the at least one active antenna element 22 to transmit interference (e.g., bare carrier wave, noise or undesired signal imposed on carrier wave) within the wireless communications band of frequencies. The frequency of operation of the interference generation circuit 36 may be implemented at manufacture, installation in the vehicle, on startup of the vehicle 4 and/or during use of the interference device 12. More specifically, the interference generation circuit 36 may include at least one variable circuit element 37 (e.g., inductor, capacitor, resistor, etc.) that may be varied according to input signals received via a reconfiguration port 38. The reconfiguration port 38 may receive a user defined input or a generated input based upon an anticipated or a detected frequency of operation of the driver operated wireless communications device 8. The reconfiguration port 38 may, for example, receive the user defined input during installation indicative of one or more frequency bands allocated to wireless communications in the geographic region in which the vehicle 4 or interference device 12 will be distributed, sold, operated and/or used. Alternatively, or additionally, the reconfiguration port 38 may for example receive the input generated in response to frequency detection. Such can accommodate new wireless communications devices and/or changes to existing wireless communications devices 8.

The interference generation circuit 36 may be electrically coupled to receive power via an electrical system of the vehicle 4. Alternatively, or additionally the interference generation circuit 36 may receive power via a power supply (e.g., a battery) or plugged into a standard electrical outlet.

The drive circuit 20 may further comprise an input port 39 or a switch 41 (FIGS. 5 and 6) coupled to the sensor 30 to receive the signal indicative of movement of the vehicle 4. A comparator 24 is configured to compare the signal indicative of the movement of the vehicle 4 with a threshold input 26 indicative of the defined threshold, thereby determining whether to trigger the interference generation circuit 36 to produce interference via the active antenna element 22. The threshold input 26 may indicate a user-defined threshold such as, for example, a speed threshold and/or an acceleration threshold and/or a change in position threshold. For example, the speed threshold may be a value indicative of a speed of approximately 5 miles per hour.

Upon determining that the signal received from the sensor 30 is above the defined threshold, the interference device 12 transmits interference via the active antenna element 22 within the wireless communications band of frequencies, which approximately matches the frequency band used by the driver operated wireless communications device 8. The interference is transmitted at sufficiently high power to substantially interfere with communications between the driver operated wireless communications device 8 and the base station 3 and at sufficiently low power to not effectively interfere with communications between base station 3 and the passenger operated wireless communications devices 10.

During manufacture, the interference generation circuit 36 may, for example, be configured to produce interference within the following frequency bands: 800 MhZ band, 900 MHz band, 1800 MHz band, or 1900 MHz band. Prior to installation, the interference generation circuit 36 may be manually reconfigured based on the geographic location (e.g., Unites States, Europe, Japan, etc.) in which the vehicle 4 is sold, leased or operated, to interfere with one or more frequencies licensed for wireless communications in that area. Reducing the number of bands to only the bands that are licensed in the geographic location may advantageously reduce possible unintended interference with other devices, reduce power consumption, and/or comply with applicable laws or regulations.

As mentioned above, the reconfiguration port 38 may receive the generated input based upon the detected frequency of operation of the driver operated wireless communications device 8. For example, the drive circuit 20 may include an optional frequency detector 40 (e.g., RF signal analyzer) to detect the wireless communications band of frequencies used by the driver operated wireless communications device 8. The variable circuit element 37 of the interference generation circuit 36 is adjusted according to the input received via the reconfiguration port 38. The frequency detector 40 may be enabled at start-up of the vehicle 4 and/or periodically thereafter or at movement of the vehicle 4 above the defined threshold and/or periodically thereafter. The frequency detector 40 may be in constant detection mode irrespective of the movement of the vehicle 4. During enablement of the frequency detector 40 (e.g., at vehicle 4 start up and periodically thereafter), the reconfiguration port 38 receives the generated inputs from the frequency detector 40 indicating the current frequency band being used by the driver operated wireless communications device 8. The reconfiguration port 38 adjusts the variable circuit element 37 accordingly, so as to ensure that the generated interference interferes with the operation of the driver operated wireless communications device 8.

In another embodiment, the reconfiguration port 38 is programmed to automatically switch the adjustment of the variable circuit element 37 and cause the interference generation circuit 36 to cycle between several frequency bands to render the driver operated wireless communications device 8 ineffective without regard to the particular one of the licensed band or bands of frequency in which the particular driver operated wireless communications device 8 is operating. The possible frequency bands may be bands licensed for wireless communications in the geographic location in which the vehicle 4 is operated.

The interference generation circuit 36 may include a tuned circuit (e.g., RLC circuit, LC circuit, etc.) with an interference generator coupled thereto. The interference generator provides interference within one or more wireless communications bands of frequencies. The tuned circuit passes interference within the wireless communications band of frequencies that approximately matches the band of frequencies used during operation of the driver operated wireless communications device 8. The tuned circuit may include the variable circuit element 37 to allow for the selection of the new band of frequencies that approximately matches the wireless communications band of frequencies used during operation of the driver operated wireless communications device 8. The variable circuit component may be, for example, a varicap diode, integrated within the tuned circuit to form a voltage controlled oscillator (VCO). The varicap diode is a diode having a large depletion region that may be varied by an applied voltage, thereby functioning as a variable capacitor. The interference generation circuit 36 may further comprise an amplification circuit to increase the power of the transmitted interference. The amplification circuit provides sufficient power such that the transmitted interference interferes with the communication between the driver operated wireless communications device 8 and the destination device 6 but does not interfere with the communications between the passenger operated wireless communications device 10 and the base station 3.

Figure 4:
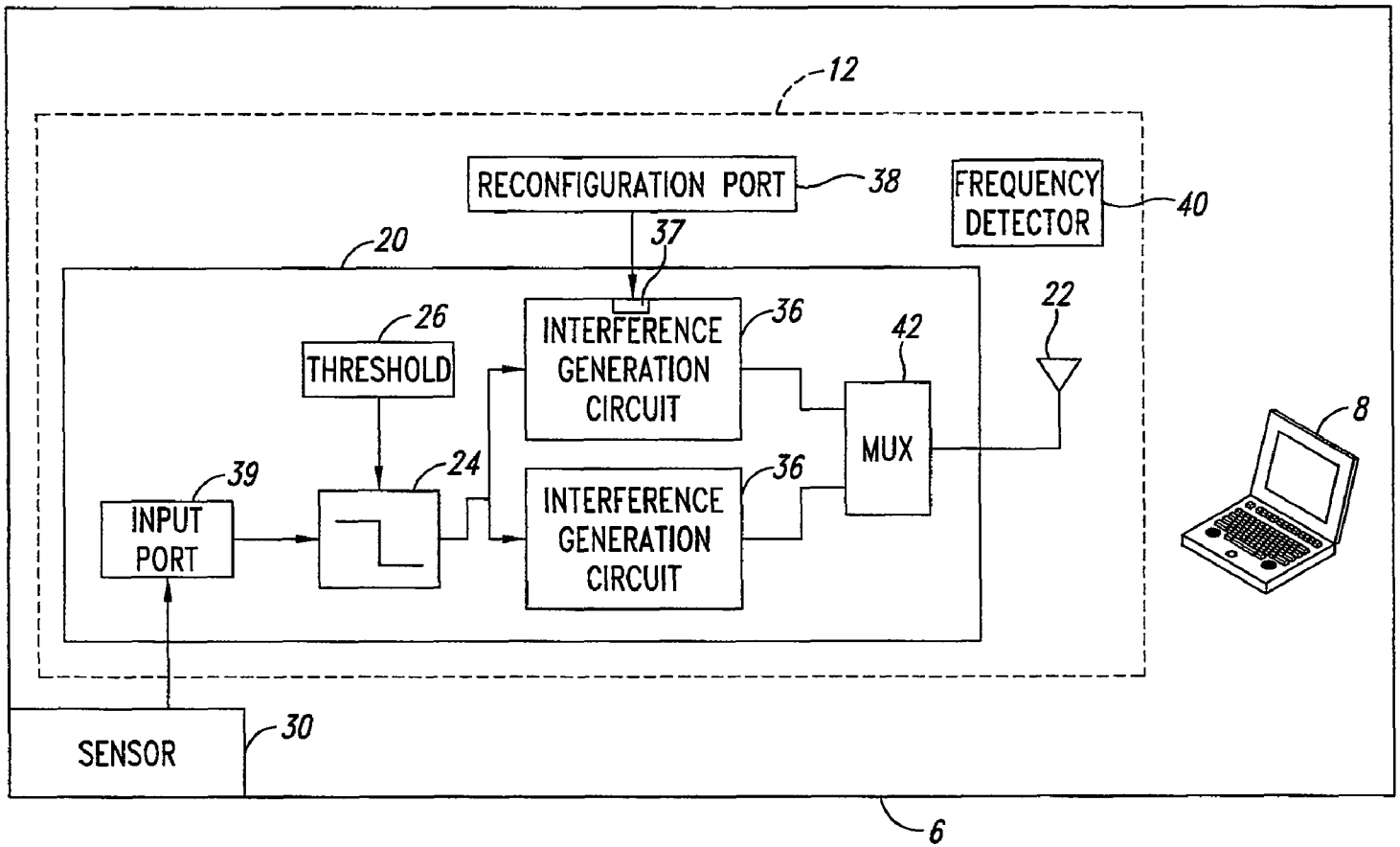
FIG. 4 is a schematic illustration of an interference device positioned within a vehicle including at least two interference generation circuits and a comparator, according to one illustrated embodiment.

FIG. 4 shows a schematic illustration of the interference device 12 positioned within the vehicle 4 and including at least two interference generation circuits 36*a*, 36*b* (collectively referenced as 36), the comparator 24 and a multiplexer 42, according to an illustrated embodiment.

The drive circuit 20 of FIG. 4 is similar in some respects to the drive circuit 20 of FIG. 3. Hence, identical or similar elements or components will be identified by the same reference numbers. Only significant differences in structure and operation are discussed below.

The multiplexer 42 is operable to selectively couple a respective one of the at least two interference generation circuits 36 to the active antenna element 22 at a time. Each of the at least two interference generation circuits 36 is operable to cause the active antenna element 22 to produce interference within a respective wireless communications band of frequencies. For example, the drive circuit 20 may include three interference generation circuits 36, wherein each is operable to cause the active antenna element 22 to produce interference within a respective one of three wireless communications bands of frequencies. The three bands of frequencies may include, for example, the 800 MhZ band, 900 MHz band, 1800 MHz band and the 1900 MHz band, as configured during manufacture or installation of the interference device 12.

The comparator 24 may trigger one or more of the interference generation circuits 36 to generate an interference signal based on the signal indicative of movement of the vehicle 4 and on the threshold input 26. The interference signal is supplied to a respective input of the multiplexer 42. The multiplexer 42 selects the respective input corresponding to the interference generation circuit 36, to cause the active antenna element 22 to produce interference within the wireless communications band of frequencies that approximately matches the frequency band used by the driver operated wireless communications device 8.

In some embodiments, the drive circuit 20 may include the frequency detector 40 that detects the frequency band or bands in which the driver operated wireless communications device 8 is operating and supplies an appropriate signal to the multiplexer 42 to cause the multiplexer 42 to select the respective input. The respective input corresponds to the interference generation circuit 36 designed to produce interference within the wireless communications band of frequencies that approximately matches the frequency band used by the driver operated wireless communications device 8. Similarly to the interference device 12 of FIG. 3, the frequency detector 40 may be enabled at start-up of the vehicle 4 and/or periodically thereafter or at movement of the vehicle 4 above the defined threshold and/or periodically thereafter. The frequency detector 40 may be in constant detection mode irrespective of the movement of the vehicle 4. During enablement of the frequency detector 40 (e.g., at vehicle 4 start up and/or periodically thereafter), the multiplexer 42 receives the signals from the frequency detector 40 to cause the multiplexer 42 to select the respective input. The respective input corresponding to the interference generation circuit 36 designed to produce interference to interfere with the current frequency band being used by the driver operated wireless communications device 8.

During manufacture, each of the interference generation circuits 36 may, for example, be configured to produce interference within the 800 MHz, 900 MHz, 1800 MHz or 1900 MHz bands, respectively. However, prior to installation, the multiplexer 42 may be manually set based on the geographic location (e.g., United States, Europe, Japan, etc.) in which the vehicle is sold, leased or operated, to select the input corresponding to the interference signal that can interfere with one or more frequencies licensed for wireless communications in that area.

Alternatively, the multiplexer 42 may be preprogrammed to automatically cycle selection between two or more inputs, effectively rendering the driver operated wireless communications device 8 ineffective without regard to the particular one of the licensed band or bands of frequency in which the particular driver operated wireless communications device 8 is operating. The two or more inputs may correspond to interference signals within respective frequency bands licensed for wireless communications in the geographic location in which the vehicle 4 is operated.

Similarly to the drive circuit 20 of FIG. 3, if neither of the interference generation circuits 36 produce interference within the frequency band used by the driver operated wireless communications device 8, the variable circuit element 37 of one of the interference generation circuits may be adjusted. The reconfiguration port 38 may receive the user defined input (e.g., during installation) or the generated input based upon the detected frequency of operation of the driver operated wireless communications device 8. The reconfiguration port 38 may, for example, receive the user defined input during installation or the generated input during frequency detection.

Figure 5:
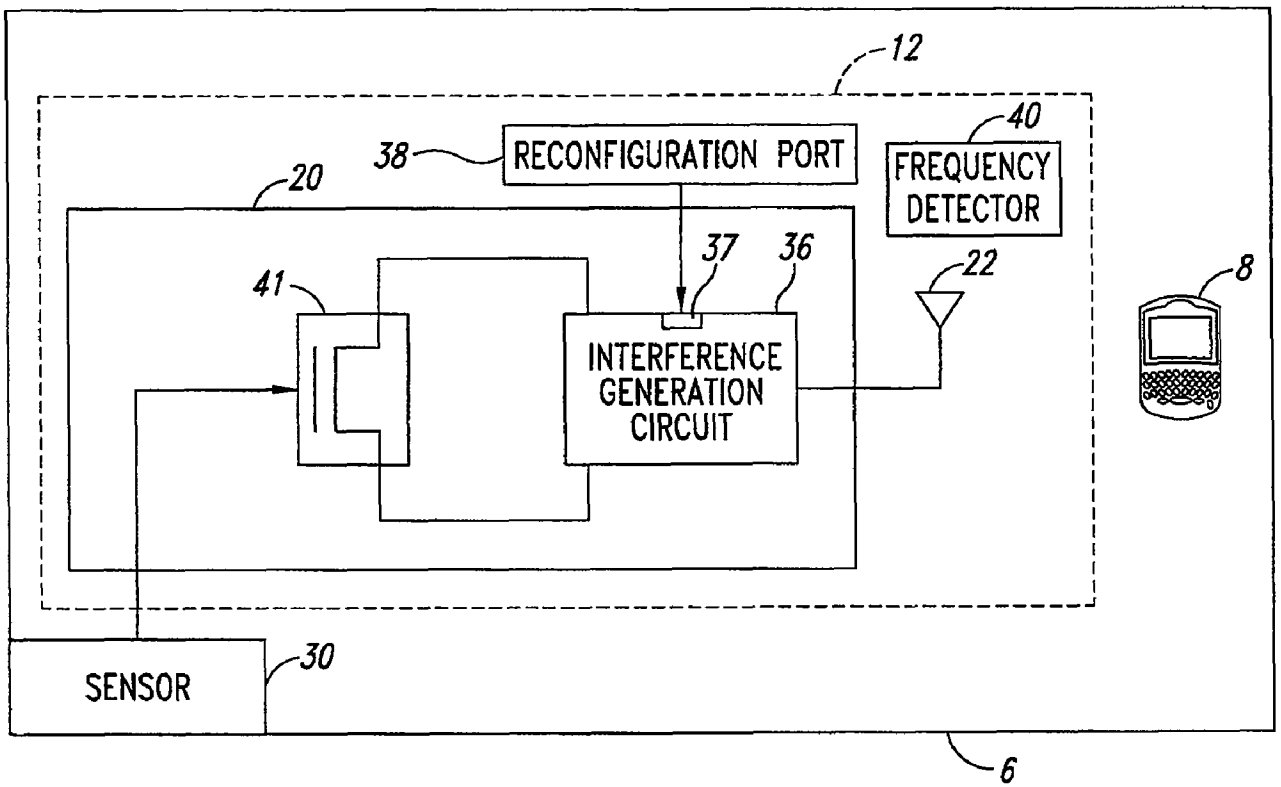
FIG. 5 is a schematic illustration of an interference device positioned within a vehicle including at least one interference generation circuit and a switch, according to one illustrated embodiment.
Figure 6:
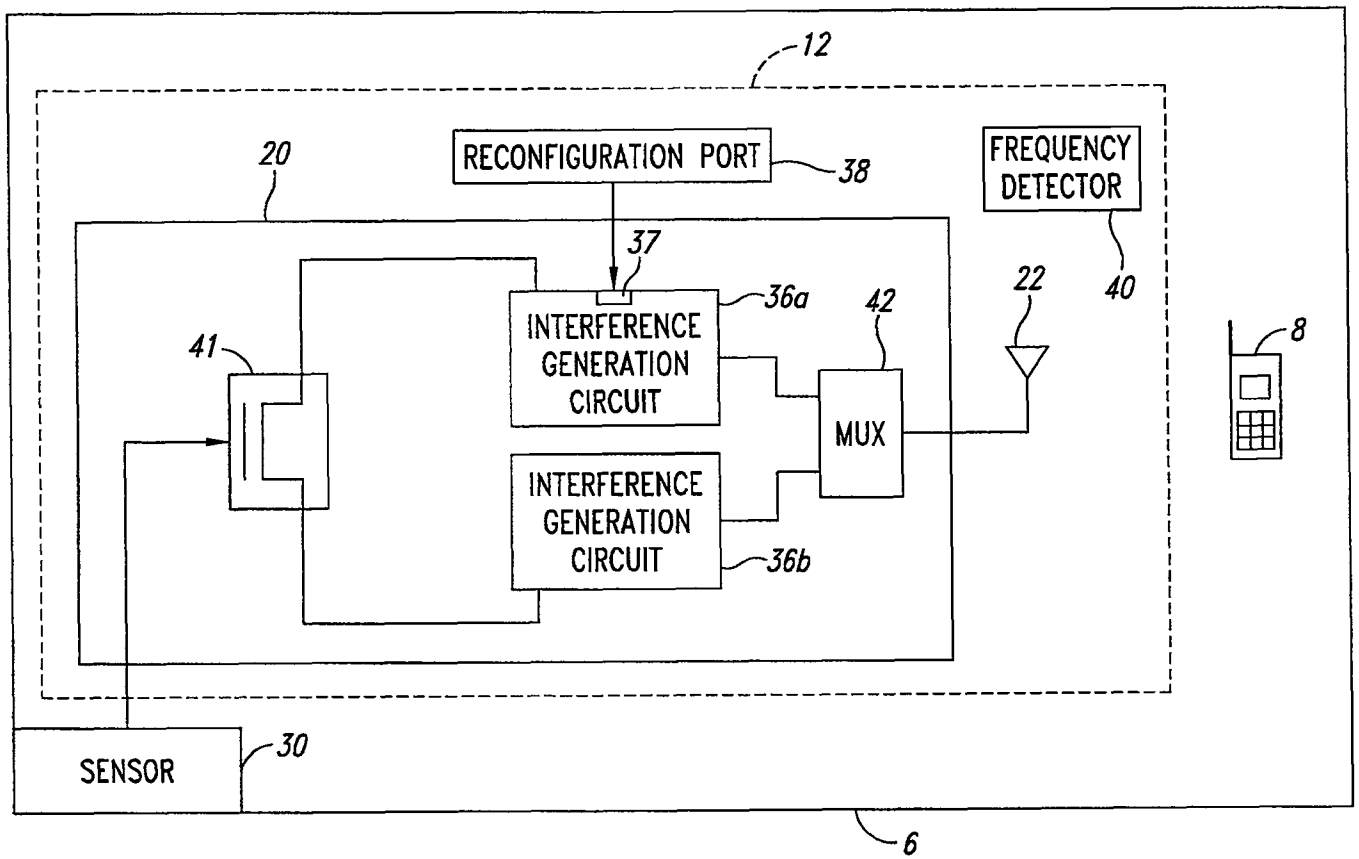
FIG. 6 is a schematic illustration of an interference device positioned within a vehicle including at least two interference generation circuits and a switch, according to one illustrated embodiment.

FIG. 5 shows a schematic illustration of the interference device 12 including the at least one interference generation circuit 36 coupled to the switch 41 positioned within the vehicle 4, according to one illustrated embodiment. FIG. 6 shows a schematic illustration of the interference device 12 including the at least two interference generation circuits 36 coupled to the switch 41 positioned with the vehicle 4, according to another illustrated embodiment.

The drive circuit 20 of FIGS. 5 and 6 is similar in some respects to the drive circuit 20 of FIGS. 3 and 4, respectively. Hence, identical or similar elements or components will be identified by the same reference numbers. Only significant differences in structure and operation are discussed below.

As illustrated in FIG. 5, the drive circuit 20 may comprise the switch 41 responsive to the signal indicative of movement of the vehicle 4 above the defined threshold. The switch 41 selectively couples the interference generation circuit 36 to the at least one active antenna element 22 to produce interference within the at least one wireless communications band of frequencies. The switch 41 closes and creates an electrical path when the signal indicative of movement of the vehicle 4 exceeds the defined threshold. The defined threshold may, for example, be set by the resistance of a gate resistor coupled to the switch 41. In at least one embodiment, the circuit may be designed such that a voltage drop across the switch 41 (e.g., transistor) sets the threshold. The switch 41 may be a digital switch having design features that define the turn-on threshold indicative of the defined threshold. The switch 41 may be, for example, a Metal Oxide Field Effect Transistor (MOSFET), Bipolar Junction Transistor (BJT), Metal Oxide Semiconductor (MOS) transistor, Complimentary Metal Oxide Semiconductor (CMOS) transistor, or any suitable transistor.

The switch 41 is electrically coupled to the sensor 30 to receive the signal indicative of movement of the vehicle 4. The movement of the vehicle 4 may, for example, be a change of position, speed or acceleration of the vehicle 4. The signal indicating the movement of the vehicle 4 may take the form of a voltage or a current being applied to the switch 41. When the signal is above the turn-on threshold the switch 41 is in an ON or CLOSED state. When the signal applied to the switch 41 is below the turn-on threshold, the switch 41 is in an OFF or OPENED state so as to disconnect the interference generation circuit 36 and prevent the transmission of the interference within the wireless communications band of frequencies.

As described in FIG. 4, the drive circuit 20 may comprise at least two interference generation circuits 36 coupled to the multiplexer 42 and operable to selectively couple the respective one of the at least two interference generation circuits 36 to the active antenna element 22 at a time. Each of the at least two interference generation circuits 36 is operable to cause the active antenna element 22 to produce interference within the respective wireless communications band of frequencies. Referring to FIG. 6, the at least two interference generation circuits 36 are coupled to the switch 41. Based on the signal received from the sensor 30, the switch 41 may trigger each of the at least two interference generation circuits 36 to provide interference signals to the respective inputs of the multiplexer 42. The multiplexer 42 couples the respective input corresponding to the interference generation circuit 36 designed to cause the active antenna element 22 to produce interference within the wireless communications band of frequencies that approximately matches the frequency band used by the wireless communications device 8.

Similarly to the drive circuit 20 described in FIGS. 3 and 4 the interference generation circuit 36 may include at least one variable circuit element 37 that may be adjusted according to the signal received at the reconfiguration port 38.

Figure 7:
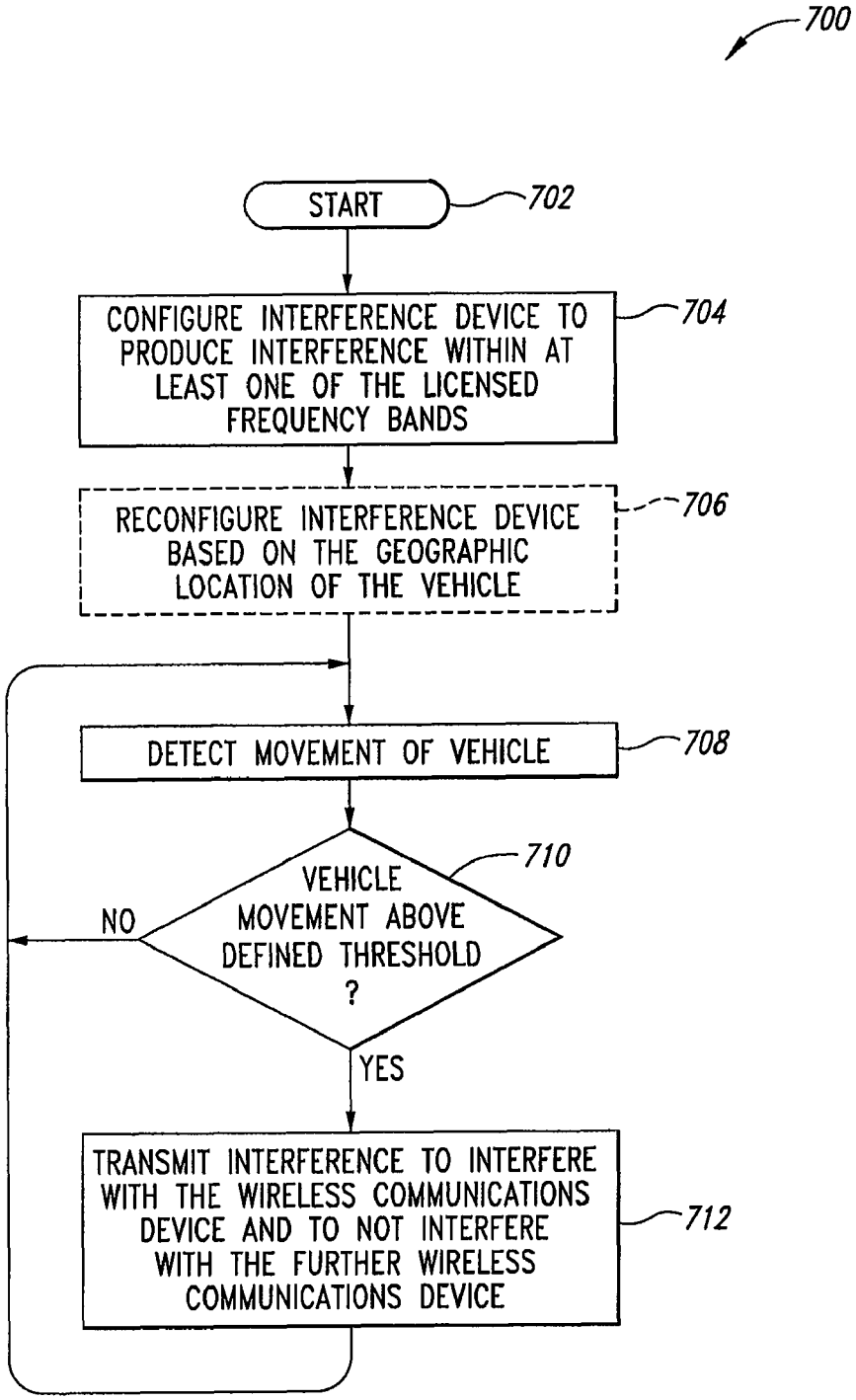
FIG. 7 is a flowchart of a method of disabling operation of wireless communications devices within the vehicle, according to one illustrated embodiment.

FIG. 7 shows a flowchart of a method 700 of disabling operation of the driver operated wireless communications device 8 within the vehicle, according to one illustrated embodiment.

The method 700 starts at 702, for example in response to the start of manufacture of the interference device 12. At 704, the interference device 12 is configured to produce interference within at least one of the frequency bands licensed for wireless communications in the geographic region in which the interference device 12 will be distributed, sold and/or used.

Optionally at 706, prior to installation of the interference device 12, the interference generation circuit 36 is manually configured based on the geographic location (e.g., Unites States, Europe, Japan, etc.) in which the vehicle 4 is sold, leased or operated, to interfere with one or more frequencies licensed for wireless communications in that area.

At 708, in response to the starting up or movement of the vehicle 4, the sensor 30 sends the signal indicative of the movement of the vehicle 4 to the drive circuit 20. The signal may be indicative of position, speed and/or acceleration of the vehicle 4 or a component thereof, for example, a drive shaft or axle.

At 710, at least one of the comparator 24 or the switch 41 determines whether the movement of the vehicle 4 exceeds the defined threshold. As discussed above, the threshold may be defined via the threshold input 26 or the turn-on threshold of the switch 41. The signal indicative of the movement of the vehicle 4 is compared to the defined threshold. If it is determined that the vehicle 4 is moving below the defined threshold, control passes back to 708.

At 712, the interference device 12 transmits interference within the at least one wireless communications band of frequencies that approximately matches the frequency band used by the wireless communications device 8. The transmitted interference is sufficient to effectively interfere with the communication between the driver operated wireless communications device 8 and the base station 3 to render the driver operated wireless communications device 8 inoperable, and to not effectively interfere with the communication between the passenger operated wireless communications device 10 and the base station 3, thus rendering the passenger operated wireless communications device 10 operable.

The method 700 passes control to 708 and waits for the signal indicative of the movement of the vehicle 4 to be above the defined threshold.

It will be apparent to those of skill in the art, that the acts of the method 700 may be performed in a different order. It will also be apparent to those with skill in the art, that the method 700 omits some acts and/or may include additional acts.

Figure 8:
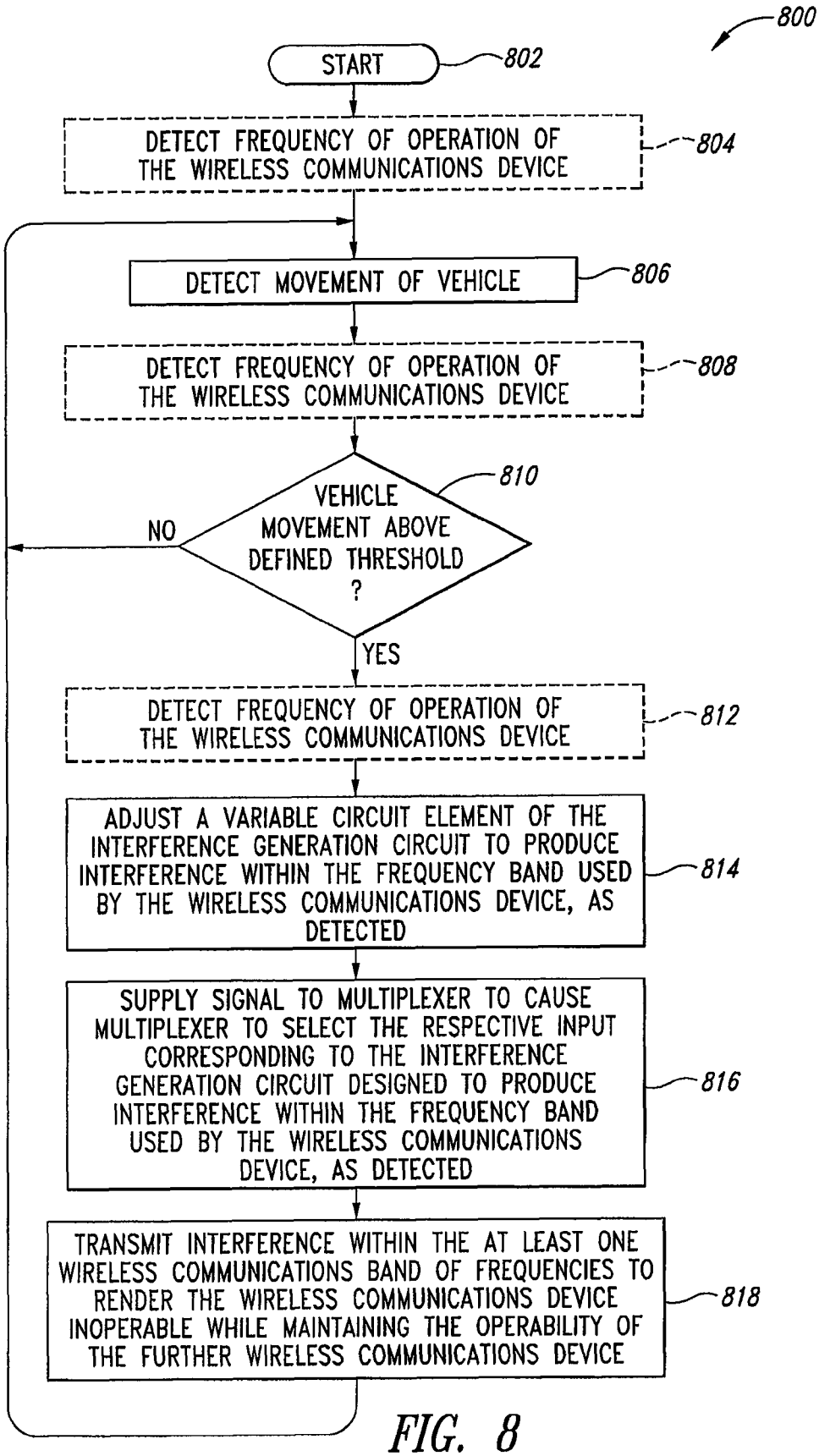
FIG. 8 is a flowchart of a method of disabling operation of wireless communications devices within the vehicle, according to one illustrated embodiment.

FIG. 8 shows a flowchart of a method 800 of disabling operation of the wireless communications devices 8 within the vehicle 4, according to one illustrated embodiment.

The method 800 starts at 802, for example in response to the starting up or movement of the vehicle 4. Optionally at 804, in the event that the driver operated wireless communications device 8 is in use, the frequency detector 40 detects the frequency of operation of the driver operated wireless communications device 8.

At 806, the sensor 30 sends the signal indicative of the movement of the vehicle 4 to the drive circuit 20. The signal may be indicative of position, speed and/or acceleration of the vehicle 4 or a component thereof, for example, a drive shaft or axle.

Optionally at 808, in the event that the driver operated wireless communications device 8 is in use, the frequency detector 40 detects the frequency of operation of the driver operated wireless communications device 8.

At 810, at least one of the comparator 24 or the switch 41 determines whether the movement of the vehicle 4 exceeds the defined threshold. As discussed above, the threshold may be defined via the threshold input 26 or the turn-on threshold of the switch 41. As described above, the signal indicative of the movement of the vehicle 4 is compared to the defined threshold. If it is determined that the vehicle 4 is moving below the defined threshold, control passes to 806.

Optionally at 812, in the event that the driver operated wireless communications device 8 is in use, the frequency detector 40 detects the frequency of operation of the driver operated wireless communications device 8.

Optionally at 814, based upon a signal generated by the frequency detector, the at least one variable circuit element 37 of the interference generation circuit 36 is adjusted to produce interference within the at least one wireless communications band of frequencies that approximately matches the frequency band used by the driver operated wireless communications device 8, as detected.

Optionally at 816, a signal is supplied to the multiplexer 42, for example, from the frequency detector 40 to cause the multiplexer 42 to select the respective input corresponding to the interference generation circuit 36 designed to produce interference within the at least one wireless communications band of frequencies that approximately matches the frequency band used by the driver operated wireless communications device 8, as detected.

At 818, the at least one of the comparator 24 or switch 41 triggers the interference generation circuit 36 to cause the active antenna element 22 to produce interference within the at least one wireless communications band of frequencies that approximately matches the frequency band used by the driver operated wireless communications device 8, as detected. If there are at least two interference generation circuits 36 in the drive circuit 20 then the at least one of the comparator 24 or switch 41 may trigger each of the at least two interference generation circuits 36 to generate interference within the respective wireless communications band of frequencies to the respective input of the multiplexer 42. The multiplexer 42 selects the respective input corresponding to the interference generation circuit 36 designed to cause the active antenna element 22 to produce interference within the at least one wireless communications band of frequencies that approximately matches the frequency band used during operation of the driver operated wireless communications device 8. The interference is transmitted by the active antenna element 22 at sufficiently high power to effectively interfere with communication between the driver operated wireless communications device 8 and the base station 3, and at sufficiently low power to not effectively interfere with communications between the base station 3 and the passenger operated wireless communications device 10.

The method 800 passes control to 806 and waits for the signal indicative of the movement of the vehicle 4 to be above the defined threshold.

It will be apparent to those of skill in the art, that the acts of the method 800 may be performed in a different order. It will also be apparent to those with skill in the art, that the method 800 omits some acts and/or may include additional acts.

Figure 9:
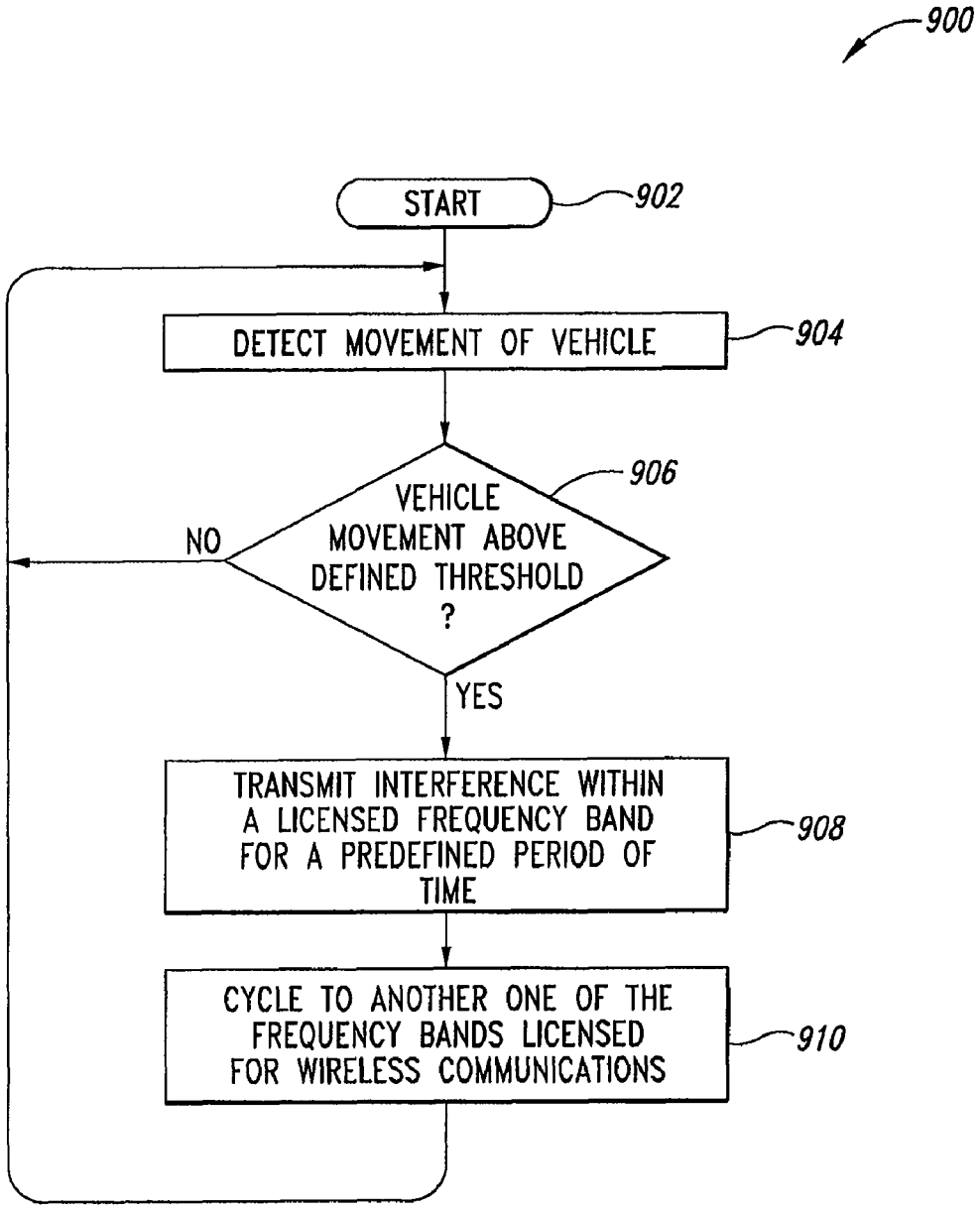
FIG. 9 is a flowchart of a method of disabling operation of wireless communications devices within the vehicle, according to one illustrated embodiment.

FIG. 9 shows a flowchart of a method 900 of disabling operation of the driver operated wireless communications devices 8 within the vehicle 4, according to one illustrated embodiment.

The method 900 starts at 902, for example in response to the starting up or movement of the vehicle 4. At 904, the sensor 30 sends the signal indicative of the movement of the vehicle 4 to the drive circuit 20. The signal may be indicative of position, speed and/or acceleration of the vehicle 4 or a component thereof, for example, a drive shaft or axle.

At 906, at least one of the comparator 24 or the switch 41 determines whether the movement of the vehicle 4 exceeds the defined threshold. As discussed above, the threshold may be defined via the threshold input 26 or the turn-on threshold of the switch 41. As described above, the signal indicative of the movement of the vehicle 4 is compared to the defined threshold. If it is determined that the vehicle 4 is moving below the defined threshold, control passes back to 904.

At 908, the interference device 12 transmits interference within one of the frequency bands licensed for wireless communications in the geographic location in which the vehicle 4 is operated. The interference device 12 transmits the interference within the selected frequency band for a predefined period of time. During the predefined period of time, the interference device 12 produces interference at sufficiently high power to effectively interfere with communication between the base station 3 and the driver operated wireless communications device 8, and at sufficiently low power to not effectively interfere with communications between the base station 3 and the passenger operated wireless communications device 10.

At 910, the interference device 12 cycles to another one of the frequency bands licensed for wireless communications, different from the selected frequency band at 908.

The method 900 passes control to 904 and waits for the signal indicative of the movement of the vehicle 4 to be above the defined threshold.

It will be apparent to those of skill in the art, that the acts of the method 900 may be performed in a different order. It will also be apparent to those with skill in the art, that the method 900 omits some acts and/or may include additional acts.

FIG. 10 shows a flowchart of a method 1000 of operating the directional antenna to disable the operation of the driver operated wireless communications device 8 without disabling operation of the passenger operated wireless communications device 10, according to one illustrated embodiment.

The method 1000 starts at 1002, for example in response to the start of manufacture of the vehicle 4. At 1004, the directional antenna is mounted in one of the seatback 25 or headrest 28 of the driver's seat to be occupied by the human driver 16 when controlling the vehicle 4, or in the visor 23 positioned relatively above and in front of a portion of the driver's seat 14 to be occupied by the human driver 16 when controlling the vehicle 4.

At 1006, in response to the starting up or movement of the vehicle 4, the sensor 30 sends the signal indicative of the movement of the vehicle 4 to the drive circuit 20. The signal may be indicative of position, speed and/or acceleration of the vehicle 4 or a component thereof, for example, a drive shaft or axle.

At 1008, at least one of the comparator 24 or the switch 41 determines whether the movement of the vehicle 4 exceeds the defined threshold. As discussed above, the threshold may be defined via the threshold input 26 or the turn-on threshold of the switch 41. The signal indicative of the movement of the vehicle 4 is compared to the defined threshold. If it is determined that the vehicle 4 is moving below the defined threshold, control passes back to 1006.

At 1010, in response to determining that the vehicle 4 is moving above the defined threshold, the drive circuit 20 drives the at least one active antenna element 22 at a power level that is sufficiently high to produce communications disabling interference within at least one wireless communications band of frequencies in a volume that would be occupied by the human driver 16 when controlling the vehicle 4. The communications disabling interference is also sufficiently low so as not to produce communications disabling interference in a volume to be occupied by passengers who are not the driver 16. Thus, the communication between the driver operated wireless communications device 8 and the base station 3 is rendered inoperable while the communication between the passenger operated wireless communications device 16 and the base station 3 remains operable.

The method 1000 passes control to 1006 and waits for the signal indicative of the movement of the vehicle 4 to be above the defined threshold.

It will be apparent to those of skill in the art, that the acts of the method 1000 may be performed in a different order. It will also be apparent to those with skill in the art, that the method 1000 omits some acts and/or may include additional acts.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An apparatus operable to disable operation of wireless communications devices, for use within a vehicle having a driver's seat from which a human driver controls the vehicle, the apparatus comprising:

a directional antenna including at least one active antenna element, the directional antenna mounted in one of a seat back or a head rest of the driver's seat or in a visor that is positioned above and directly in front of the driver's seat, the directional antenna having a principal axis of emission directed toward a portion of the driver's seat to be occupied by the human driver while controlling the vehicle; and a drive circuit coupled to drive the at least one active antenna element to produce interference within at least one wireless communications band of frequencies in response to movement of the vehicle above a defined threshold, and at sufficiently high power to effectively interfere with communication between a destination device and a wireless communications device positioned in a volume to be occupied by the human driver when the human driver controls the vehicle where the interference disables the communication, and at sufficiently low power to not effectively interfere with communications between the destination device and a wireless communications device positioned relatively behind the driver's seat.

2. The apparatus of claim 1 wherein the directional antenna is sufficiently directional and the drive circuit drives the at least one active antenna element at sufficiently low power to not interfere with communications between a wireless communications device positioned in a passenger seat spaced laterally with respect to the driver's seat.

3. The apparatus of claim 1 wherein the directional antenna is sufficiently directional and the drive circuit drives the at least one active antenna element at sufficiently low power to not interfere with communications between a wireless communications device positioned laterally with respect to the driver's seat by a distance of approximately 1 foot.

4. The apparatus of claim 1 wherein the drive circuit comprises an input port coupleable to receive a signal indicative of the movement of the vehicle.

5. The apparatus of claim 1 wherein the drive circuit comprises an input port coupled to at least one of a speedometer, tachometer or a rotational encoder to receive a signal indicative of the movement of the vehicle.

6. The apparatus of claim 1 wherein the drive circuit comprises an acceleration sensor operable to provide a signal indicative of the movement of the vehicle.

7. The apparatus of claim 1 wherein the drive circuit comprises a comparator configured to compare a signal indicative of the movement of the vehicle with a threshold value.

8. The apparatus of claim 1 wherein the drive circuit comprises a comparator configured to compare a signal indicative of the movement of the vehicle with a threshold value of approximately 5 miles per hour.

9. The apparatus of claim 1 wherein the drive circuit comprises a comparator configured to compare a signal indicative of the movement of the vehicle with a user set threshold value.

10. The apparatus of claim 1 wherein the drive circuit is operable to drive the at least one active antenna element to produce interference within at least two distinct wireless communications bands of frequencies in response to the movement of the vehicle above the defined threshold.

11. The apparatus of claim 10 wherein the wireless communications bands of frequencies include at least two selected from the group consisting of an 800 MHz band, a 900 MHz band, an 1800 MHz band, and a 1900 MHz band.

12. The apparatus of claim 1 wherein the drive circuit comprises at least two interference generation circuits, each operable to cause the at least one active antenna element to produce interference within a respective one of at least two wireless communications band of frequencies.

13. The apparatus of claim 12 wherein the drive circuit comprises a multiplexer operable to selectively couple a respective one of the at least two interference generation circuits to the active antenna element at a time.

14. The apparatus of claim 1 wherein the drive circuit is reconfigurable to drive the at least one active antenna element to produce interference within a new wireless communications band of frequencies, different from the at least one band of wireless communications frequencies in response to a reconfiguration input.

15. The apparatus of claim 1 wherein the active antenna element is a directional antenna element.

16. The apparatus of claim 1 wherein the active antenna element is a directional antenna element.

17. The apparatus of claim 1, further comprising:

a passive antenna element positioned with respect to the active antenna element to produce a directional emission pattern.

18. The apparatus of claim 17 wherein the passive antenna element is a portion of a cylinder, with a longitudinally extending slot extending a length thereof.

19. The apparatus of claim 1 wherein the drive circuit is operable to produce a carrier wave within at least one wireless communications band of frequencies, without any signal or noise imposed on the carrier wave.

20. The apparatus of claim 1 wherein the drive circuit is operable to produce noise in at least one wireless communications band of frequencies.

21. A method to disable operation of wireless communications devices within vehicles having a driver's seat to be occupied by a human driver when controlling the vehicle, the method comprising:

locating a directional antenna having at least one active antenna element in one of a seatback or headrest of a driver's seat to be occupied by a human driver when controlling a vehicle, or in a visor positioned relatively above and in front of a portion of the driver's seat to be occupied by the human driver when controlling the vehicle;

determining whether the vehicle is moving above a defined threshold; and in response to determining that the vehicle is moving above the defined threshold, driving the at least one active antenna element at a power level that is sufficiently high to produce communications disabling interference within at least one wireless communications band of frequencies in a volume that would be occupied by the human driver when controlling the vehicle and that is sufficiently low to not produce communications disabling interference in a volume to be occupied by passengers who are not the driver.

22. The method of claim 21 wherein determining whether the vehicle is moving above the defined threshold comprises receiving a signal from a sensor of the vehicle indicative of a speed of the vehicle and comparing the signal indicative of the speed of the vehicle to a speed threshold.

23. The method of claim 21 wherein determining whether the vehicle is moving above the defined threshold comprises receiving a signal from a sensor of the vehicle indicative of an acceleration of the vehicle and comparing the signal indicative of the acceleration of the vehicle to an acceleration threshold.

24. The method of claim 21 wherein determining whether the vehicle is moving above the defined threshold comprises detecting an acceleration of the vehicle and comparing the acceleration of the vehicle to an acceleration threshold.

25. The method of claim 21 wherein driving at least one active antenna element to produce the communications disabling interference within at least one wireless communications band of frequencies comprises driving the at least one active antenna element to produce the communications disabling interference within at least two distinct wireless communications bands of frequencies.

26. The method of claim 21 wherein driving at least one active antenna element to produce the communications disabling interference within at least one wireless communications band of frequencies comprises selectively coupling a respective one of at least two interference generation circuits to the active antenna element at a time.

27. The method of claim 21 wherein driving at least one active antenna element to produce the communications disabling interference within at least one wireless communications band of frequencies comprises driving the at least one active antenna element to produce the communications disabling interference within a new wireless communications band of frequencies, different from the at least one band of wireless communications frequencies in response to a reconfiguration input.

28. The method of claim 21 wherein driving at least one active antenna element comprises producing a directional radiation pattern from the seatback or headrest of the driver's seat or visor with a primary axis of the directional radiation pattern directed toward the portion of the driver's seat to be occupied by the human driver when controlling the vehicle.

29. The method of claim 21 wherein driving at least one active antenna element comprises producing a bare carrier wave at sufficient power to disablingly interfere with communication in the volume that would be occupied by the human driver when controlling the vehicle.

30. An apparatus operable to disable operation of wireless communications devices, for use within a vehicle having a driver's seat to be occupied by a human driver while controlling the vehicle, the apparatus comprising:

a directional antenna including at least one active antenna element located in one of a seatback or a headrest of a driver's seat or a visor positioned relatively above and in front of the driver's seat and having a principal axis of emission directed toward a portion of the driver's seat to be occupied by the human driver when controlling the vehicle; and means for driving the at least one active antenna element to produce interference within at least one wireless communications band of frequencies in response to movement of the vehicle above a defined threshold, and at sufficient power to disablingly interfere with communication between a destination device and a wireless communications device positioned in a volume extending approximately perpendicularly upward from a portion of the driver's seat upon which the human driver sits when the human driver controls the vehicle while not disablingly interfering with wireless communications devices positioned in a volume to be occupied by human passengers that are not the human driver.

31. The apparatus of claim 30 wherein the means for driving the at least one active antenna element comprises a drive circuit having a switch responsive to movement of the vehicle above the defined threshold to selectively couple an interference generation circuit to the at least one active antenna element to produce interference within the at least one wireless communications band of frequencies.

32. The apparatus of claim 31 wherein the switch is coupled to receive a signal indicative of the movement of the vehicle.

33. The apparatus of claim 31 wherein the switch is coupled to at least one of a speedometer, tachometer or a rotational encoder to receive a signal indicative of the movement of the vehicle.

34. The apparatus of claim 31 wherein the drive circuit comprises an acceleration sensor operable to provide a signal indicative of the movement of the vehicle.

35. The apparatus of claim 31 wherein the drive circuit comprises a comparator configured to compare a signal indicative of the movement of the vehicle with a threshold value.

36. The apparatus of claim 31 wherein the drive circuit comprises a comparator configured to compare a signal indicative of the movement of the vehicle with a user set threshold value.

37. The apparatus of claim 31 wherein the drive circuit is operable to drive the at least one active antenna element to produce interference within at least two distinct wireless communications bands of frequencies in response to movement of the vehicle above the defined threshold.

38. The apparatus of claim 31 wherein the wireless communications bands of frequencies include at least two selected from the group consisting of an 800 MHz band, a 900 MHz band, an 1800 MHz band, and a 1900 MHz band.

39. The apparatus of claim 31 wherein the drive circuit comprises at least two interference generation circuits, each operable to cause the at least one active antenna element to produce interference within a respective one of at least two wireless communications band of frequencies.

40. The apparatus of claim 39 wherein the drive circuit comprises a multiplexer operable to selectively couple a respective one of the at least two interference generation circuits to the active antenna element at a time.

41. The apparatus of claim 31 wherein the drive circuit is reconfigurable to drive the at least one active antenna element to produce interference within a new wireless communications band of frequencies, different from the at least one band of wireless communications frequencies in response to a reconfiguration input.

42. The apparatus of claim 31 wherein the active antenna element is a directional antenna element.

43. The apparatus of claim 31, further comprising:

a passive antenna element positioned with respect to the active antenna element to produce a directional radiation pattern.

* * * * *